US008434969B2

(12) United States Patent
White

(10) Patent No.: US 8,434,969 B2
(45) Date of Patent: May 7, 2013

(54) INTERNAL PIPE CLAMP

(75) Inventor: John L. White, Kent, WA (US)

(73) Assignee: American Piledriving Equipment, Inc., Kent, WA (US)

( * ) Notice: Subject to any disclaimer, the term of this patent is extended or adjusted under 35 U.S.C. 154(b) by 222 days.

(21) Appl. No.: 13/077,664

(22) Filed: Mar. 31, 2011

(65) Prior Publication Data

US 2011/0243668 A1 Oct. 6, 2011

Related U.S. Application Data

(60) Provisional application No. 61/320,452, filed on Apr. 2, 2010.

(51) Int. Cl.
*E02D 7/28* (2006.01)

(52) U.S. Cl.
USPC ..... 405/249; 405/232

(58) Field of Classification Search ..... 405/231, 405/232, 249
See application file for complete search history.

(56) References Cited

U.S. PATENT DOCUMENTS

| | | | |
|---|---|---|---|
| 5,015 | A | 3/1847 | Ingalls |
| 48,515 | A | 7/1865 | Campbell et al. |
| 369,176 | A | 8/1887 | Gerstein |
| 400,209 | A | 3/1889 | Haskins |
| 628,962 | A | 7/1899 | Speer |
| 999,334 | A | 8/1911 | Pearson |
| 1,128,808 | A | 2/1915 | Manoogian |
| 1,213,800 | A | 1/1917 | Piper |
| 1,288,989 | A | 12/1918 | Rees |
| 1,294,154 | A | 2/1919 | Payne |
| 1,322,470 | A | 11/1919 | Schenk |
| 1,348,994 | A | 8/1920 | Heckle |
| 1,464,231 | A | 8/1923 | Yezek |

(Continued)

FOREIGN PATENT DOCUMENTS

| | | |
|---|---|---|
| DE | 4010357 | 10/1990 |
| DE | 102006053482 | 6/2008 |

(Continued)

OTHER PUBLICATIONS

American Piledriving Equipment, Inc., A series of photographs identified by Reference Nos. APE01147-APE01159, undated, 13 pages.

(Continued)

*Primary Examiner* — Frederick L Lagman
(74) *Attorney, Agent, or Firm* — Michael R. Schacht; Schacht Law Office, Inc.

(57) ABSTRACT

A clamp system includes a frame, a plurality of clamp members, an actuator collar, and an actuator system. The frame includes an attachment member and a stop ring defining a stop cam surface. The clamp members each define first and second cam surfaces. The actuator collar defines an actuator cam surface. The actuator system displaces the actuator collar. The frame supports the actuator collar and the plurality of clamp members such that the first cam surfaces engage the actuator cam surface and the second cam surfaces engage the stop cam surface. Operation of the actuator system displaces the actuator collar towards the stop ring. As the actuator collar moves towards the stop ring, the actuator cam surface acts on the first cam surfaces and the stop cam surface acts on the second cam surfaces such that the clamp members place the clamp system in an engaged configuration.

20 Claims, 4 Drawing Sheets

U.S. PATENT DOCUMENTS

| | | | |
|---|---|---|---|
| 1,654,093 | A | 12/1927 | Reid |
| 1,702,349 | A | 2/1929 | Krell |
| 1,748,555 | A | 2/1930 | Kinney |
| 1,762,037 | A | 6/1930 | Taylor |
| 1,769,169 | A | 7/1930 | Thornley |
| 1,787,000 | A | 12/1930 | Hunt |
| 1,903,555 | A | 4/1933 | Robertson |
| 1,914,899 | A | 6/1933 | Syme |
| 1,988,173 | A | 1/1935 | Kersting |
| 2,068,045 | A | 1/1937 | Wohlmeyer |
| 2,239,024 | A | 4/1941 | Vance |
| 2,577,252 | A | 12/1951 | Kjellman |
| 2,723,532 | A | 11/1955 | Smith |
| 2,755,783 | A | 7/1956 | Kupka |
| 2,842,972 | A | 7/1958 | Houdart |
| 2,859,628 | A | 11/1958 | Arko |
| 2,904,964 | A | 9/1959 | Kupka |
| 2,952,132 | A | 9/1960 | Urban |
| 3,001,515 | A | 9/1961 | Haage |
| 3,004,389 | A | 10/1961 | Muller |
| 3,034,304 | A | 5/1962 | Upson |
| 3,094,007 | A | 6/1963 | Luhrs |
| 3,100,382 | A | 8/1963 | Muller |
| 3,101,552 | A | 8/1963 | Tandler |
| 3,106,258 | A | 10/1963 | Muller |
| 3,115,198 | A | 12/1963 | Kuss |
| 3,149,851 | A | 9/1964 | Adams |
| 3,172,485 | A | 3/1965 | Spannhake et al. |
| 3,177,029 | A | 4/1965 | Larson |
| 3,193,026 | A | 7/1965 | Kupka |
| 3,227,483 | A | 1/1966 | Guild et al. |
| 3,243,190 | A | 3/1966 | Peregrine |
| 3,267,677 | A | 8/1966 | Bollar |
| 3,289,774 | A | 12/1966 | Bodine, Jr. |
| 3,300,987 | A | 1/1967 | Maeda |
| 3,313,376 | A | 4/1967 | Holland, Sr. |
| 3,371,727 | A | 3/1968 | Belousov et al. |
| 3,381,422 | A | 5/1968 | Olson |
| 3,391,435 | A | 7/1968 | Lebelle |
| 3,394,766 | A | 7/1968 | Lebelle |
| 3,412,813 | A | 11/1968 | Johnson |
| 3,447,423 | A | 6/1969 | Henry |
| 3,450,398 | A | 6/1969 | Barnes |
| 3,460,637 | A | 8/1969 | Schulin |
| 3,513,587 | A | 5/1970 | Fischer |
| 3,530,947 | A | 9/1970 | Gendron et al. |
| 3,577,645 | A | 5/1971 | Zurawski |
| 3,583,497 | A | 6/1971 | Kussowski et al. |
| 3,616,453 | A | 10/1971 | Philpot |
| 3,620,137 | A | 11/1971 | Prasse |
| 3,638,738 | A | 2/1972 | Varnell |
| 3,679,005 | A | 7/1972 | Inaba et al. |
| 3,684,037 | A | 8/1972 | Bodine |
| 3,686,877 | A | 8/1972 | Bodin |
| 3,711,161 | A | 1/1973 | Proctor et al. |
| 3,720,435 | A | 3/1973 | Leyn |
| 3,734,209 | A | 5/1973 | Haisch et al. |
| 3,786,874 | A | 1/1974 | Jodet et al. |
| 3,789,930 | A | 2/1974 | Nishimura et al. |
| 3,797,585 | A | 3/1974 | Ludvigson |
| 3,822,969 | A | 7/1974 | Kummel |
| 3,828,864 | A | 8/1974 | Haverkamp et al. |
| 3,854,418 | A | 12/1974 | Bertin |
| 3,861,664 | A | 1/1975 | Durkee |
| 3,865,501 | A | 2/1975 | Kniep |
| 3,871,617 | A | 3/1975 | Majima |
| 3,874,244 | A | 4/1975 | Rasmussen et al. |
| 3,891,186 | A | 6/1975 | Thorsell |
| 3,907,042 | A | 9/1975 | Halwas et al. |
| 3,952,796 | A | 4/1976 | Larson |
| 3,959,557 | A | 5/1976 | Berry |
| 3,967,688 | A | 7/1976 | Inenaga et al. |
| 3,975,918 | A | 8/1976 | Jansz |
| 3,991,833 | A | 11/1976 | Ruppert |
| 3,998,063 | A | 12/1976 | Harders |
| 4,018,290 | A | 4/1977 | Schmidt |
| 4,029,158 | A | 6/1977 | Gerrish |
| 4,033,419 | A | 7/1977 | Pennington |
| 4,067,369 | A | 1/1978 | Harmon |
| 4,076,081 | A | 2/1978 | Schnell |
| 4,082,361 | A | 4/1978 | Lanfermann |
| 4,099,387 | A | 7/1978 | Frederick et al. |
| 4,100,974 | A | 7/1978 | Pepe |
| 4,102,408 | A | 7/1978 | Ludvigson |
| 4,109,475 | A | 8/1978 | Schnell |
| 4,113,034 | A | 9/1978 | Carlson |
| 4,119,159 | A | 10/1978 | Arentsen |
| 4,143,985 | A | 3/1979 | Axelsson et al. |
| 4,154,307 | A | 5/1979 | Gendron et al. |
| 4,155,600 | A | 5/1979 | Lanfermann et al. |
| 4,166,508 | A | 9/1979 | van den Berg |
| 4,180,047 | A | 12/1979 | Bertelson |
| 4,187,917 | A | 2/1980 | Bouyoucos |
| 4,195,698 | A | 4/1980 | Nakagawasai |
| 4,248,550 | A | 2/1981 | Blaschke et al. |
| 4,262,755 | A | 4/1981 | Kuhn |
| 4,274,761 | A | 6/1981 | Boguth |
| 4,312,413 | A | 1/1982 | Loftis |
| 4,362,216 | A | 12/1982 | Jansz |
| 4,366,870 | A | 1/1983 | Frederick |
| 4,375,927 | A | 3/1983 | Kniep |
| 4,380,918 | A | 4/1983 | Killop |
| 4,397,199 | A | 8/1983 | Jahn |
| 4,421,180 | A | 12/1983 | Fleishman et al. |
| 4,428,699 | A | 1/1984 | Juhola |
| 4,430,024 | A | 2/1984 | Guild et al. |
| 4,436,452 | A * | 3/1984 | Bodine ..... 405/232 |
| 4,455,105 | A | 6/1984 | Juhola |
| 4,465,145 | A | 8/1984 | Kuhn |
| 4,497,376 | A | 2/1985 | Kurylko |
| 4,505,614 | A | 3/1985 | Anschutz |
| 4,519,729 | A | 5/1985 | Clarke, Jr. et al. |
| 4,537,527 | A | 8/1985 | Juhola et al. |
| 4,547,110 | A | 10/1985 | Davidson |
| 4,553,443 | A | 11/1985 | Rossfelder et al. |
| 4,601,615 | A | 7/1986 | Cavalli |
| 4,603,748 | A | 8/1986 | Rossfelder et al. |
| 4,624,325 | A | 11/1986 | Steiner |
| 4,626,138 | A | 12/1986 | Boyes |
| 4,627,768 | A | 12/1986 | Thomas et al. |
| 4,632,602 | A | 12/1986 | Hovnanian |
| 4,637,475 | A | 1/1987 | England et al. |
| 4,645,017 | A | 2/1987 | Bodine |
| 4,687,026 | A | 8/1987 | Westman |
| 4,725,167 | A | 2/1988 | Merjan |
| 4,735,270 | A | 4/1988 | Fenyvesi |
| 4,755,080 | A | 7/1988 | Cortlever et al. |
| 4,757,809 | A | 7/1988 | Koeneman et al. |
| 4,758,148 | A | 7/1988 | Jidell |
| 4,768,900 | A | 9/1988 | Burland |
| 4,799,557 | A | 1/1989 | Jacquemet |
| 4,813,814 | A | 3/1989 | Shibuta et al. |
| 4,844,661 | A | 7/1989 | Martin et al. |
| 4,863,312 | A | 9/1989 | Cavalli |
| 4,915,180 | A | 4/1990 | Schisler |
| 4,961,471 | A | 10/1990 | Ovens |
| 4,974,997 | A | 12/1990 | Sero et al. |
| 4,989,677 | A | 2/1991 | Lam |
| 4,993,500 | A | 2/1991 | Greene et al. |
| 5,004,055 | A | 4/1991 | Porritt et al. |
| 5,018,251 | A | 5/1991 | Brown |
| 5,076,090 | A | 12/1991 | Cetnarowski |
| 5,088,565 | A | 2/1992 | Evarts |
| 5,107,934 | A | 4/1992 | Atchison |
| 5,117,925 | A | 6/1992 | White |
| 5,154,667 | A | 10/1992 | Mauch et al. |
| 5,161,625 | A | 11/1992 | Seng |
| 5,213,449 | A | 5/1993 | Morris |
| 5,253,542 | A | 10/1993 | Houze |
| RE34,460 | E | 11/1993 | Ishiguro et al. |
| 5,263,544 | A | 11/1993 | White |
| 5,281,775 | A | 1/1994 | Gremillion |
| 5,343,002 | A | 8/1994 | Gremillion |
| 5,355,964 | A | 10/1994 | White |
| 5,375,897 | A | 12/1994 | Gazel-Anthoine |
| 5,385,218 | A | 1/1995 | Migliori |
| 5,409,070 | A | 4/1995 | Roussy |

| | | | | |
|---|---|---|---|---|
| 5,410,879 | A | 5/1995 | Houze | |
| 5,423,633 | A * | 6/1995 | Verstraeten | 405/232 |
| 5,439,326 | A | 8/1995 | Goughnour et al. | |
| 5,540,295 | A | 7/1996 | Serrette | |
| 5,544,979 | A | 8/1996 | White | |
| 5,549,168 | A | 8/1996 | Sadler et al. | |
| 5,562,169 | A | 10/1996 | Barrow | |
| 5,609,380 | A | 3/1997 | White | |
| 5,653,556 | A | 8/1997 | White | |
| 5,658,091 | A | 8/1997 | Goughnour et al. | |
| 5,727,639 | A | 3/1998 | Jeter | |
| 5,794,716 | A | 8/1998 | White | |
| 5,811,741 | A | 9/1998 | Coast et al. | |
| 5,836,205 | A | 11/1998 | Meyer | |
| 5,860,482 | A | 1/1999 | Gremillion et al. | |
| 6,003,619 | A | 12/1999 | Lange | |
| 6,039,508 | A | 3/2000 | White | |
| 6,056,070 | A | 5/2000 | Shinohara et al. | |
| 6,102,133 | A | 8/2000 | Scheid et al. | |
| 6,129,159 | A | 10/2000 | Scott et al. | |
| 6,129,487 | A | 10/2000 | Bermingham et al. | |
| 6,179,527 | B1 | 1/2001 | Goughnour | |
| 6,186,043 | B1 | 2/2001 | Callies | |
| 6,216,394 | B1 | 4/2001 | Fenelon | |
| 6,224,294 | B1 | 5/2001 | Mansfield | |
| 6,227,767 | B1 | 5/2001 | Sabbaghian et al. | |
| 6,234,260 | B1 | 5/2001 | Coast et al. | |
| 6,250,426 | B1 | 6/2001 | Lombard | |
| 6,360,829 | B1 | 3/2002 | Naber et al. | |
| 6,364,577 | B1 | 4/2002 | Haney | |
| 6,386,295 | B1 | 5/2002 | Suver | |
| 6,427,402 | B1 | 8/2002 | White | |
| 6,431,795 | B2 | 8/2002 | White | |
| 6,447,036 | B1 | 9/2002 | White | |
| 6,484,553 | B1 | 11/2002 | Devers | |
| 6,543,966 | B2 | 4/2003 | White | |
| 6,557,647 | B2 | 5/2003 | White | |
| 6,582,158 | B1 | 6/2003 | Van Stein | |
| 6,648,556 | B1 | 11/2003 | White | |
| 6,652,194 | B2 | 11/2003 | Ingle | |
| 6,672,805 | B1 | 1/2004 | White | |
| 6,691,797 | B1 | 2/2004 | Hart | |
| 6,732,483 | B1 | 5/2004 | White | |
| 6,736,218 | B1 | 5/2004 | White | |
| 6,752,043 | B2 | 6/2004 | Carlson | |
| 6,860,338 | B2 | 3/2005 | Salesse et al. | |
| 6,896,448 | B1 | 5/2005 | White | |
| 6,908,262 | B1 | 6/2005 | White | |
| 6,942,430 | B1 | 9/2005 | Suver | |
| 6,988,564 | B2 | 1/2006 | White | |
| 7,043,806 | B2 | 5/2006 | Schrock et al. | |
| 7,168,890 | B1 | 1/2007 | Evarts | |
| 7,392,855 | B1 | 7/2008 | White | |
| 7,404,449 | B2 | 7/2008 | Bermingham et al. | |
| 7,407,343 | B2 * | 8/2008 | van Halteren et al. | 405/232 |
| 7,591,612 | B2 | 9/2009 | Wong | |
| 7,694,747 | B1 | 4/2010 | White | |
| 7,708,499 | B1 | 5/2010 | Evarts et al. | |
| 7,824,132 | B1 | 11/2010 | White | |
| 7,854,571 | B1 | 12/2010 | Evarts | |
| 7,950,877 | B2 | 5/2011 | Evarts | |
| 8,070,391 | B2 | 12/2011 | White | |
| 8,181,713 | B2 | 5/2012 | White | |
| 8,186,452 | B1 | 5/2012 | White et al. | |
| 2003/0143036 | A1 | 7/2003 | Larsen, Jr. | |
| 2005/0013675 | A1 | 1/2005 | Bengston et al. | |
| 2005/0232708 | A1 * | 10/2005 | White | 405/249 |
| 2006/0052818 | A1 | 3/2006 | Drake et al. | |
| 2006/0113456 | A1 | 6/2006 | Miller | |
| 2006/0216118 | A1 | 9/2006 | Wong | |
| 2008/0310923 | A1 * | 12/2008 | Jinnings et al. | 405/232 |
| 2009/0129870 | A1 | 5/2009 | Jones | |
| 2011/0081208 | A1 * | 4/2011 | White | 405/249 |
| 2011/0162859 | A1 | 7/2011 | White | |
| 2012/0114424 | A1 | 5/2012 | White | |

FOREIGN PATENT DOCUMENTS

| | | |
|---|---|---|
| EP | 0172960 | 5/1986 |
| EP | 362158 | 4/1990 |
| EP | 526743 | 10/1993 |
| FR | 838717 | 3/1939 |
| FR | 2560247 | 8/1985 |
| GB | 1066727 | 4/1967 |
| GB | 2003769 | 3/1979 |
| GB | 2023496 | 1/1980 |
| GB | 2028902 | 3/1980 |
| GB | 2043755 | 10/1980 |
| GB | 2060742 | 5/1981 |
| JP | 5494703 | 7/1979 |
| JP | 355098526 | 7/1980 |
| JP | 356034828 | 4/1981 |
| JP | 57169130 | 10/1982 |
| JP | 59228529 | 12/1984 |
| JP | 61221416 | 10/1986 |
| JP | 0258627 | 2/1990 |
| JP | 497015 | 3/1992 |
| JP | 473035 | 6/1992 |
| JP | 5246681 | 9/1993 |
| JP | 6136751 | 5/1994 |
| JP | 09328983 | 12/1997 |
| KR | 9216944 | 9/1992 |
| KR | 1020010044658 | 6/2001 |
| KR | 1020030017742 | 3/2003 |
| NL | 42349 | 1/1938 |
| NL | 65252 | 2/1950 |
| NL | 7710385 | 3/1978 |
| NL | 7707303 | 1/1979 |
| NL | 7805153 | 11/1979 |
| NO | 46428 | 4/1929 |
| SU | 1027357 | 7/1983 |
| WO | 8707673 | 12/1987 |
| WO | 8805843 | 8/1988 |

OTHER PUBLICATIONS

APE, "APE Model 8 Hydraulic Impact Hammer," undated, 1 page.
Japan Development Consultants, Inc., "Castle Board Drain Method" Japanese language brochure, Ref. Nos. APE00857-APE00863, Aug. 1976, 7 pages.
International Construction Equipment, Inc., "Diesel Pile Hammers" brochure, Ref. No. DH4-1288-5C, undated, 6 pages.
International Construction Equipment, Inc., "Hydraulic Vibratory Driver/Extractors for Piling and Caisson Work," undated, 10 pages.
International Construction Equipment, Inc., "Hydraulic Vibratory Driver/Extractors for Piling and Caisson Work," Ref. No. V7-0890-51, undated, 3 pages.
"Kony Drain Board," undated, 1 page.
Korean language documents identified by Ref. Nos. APE00864-APE00891, dates from 1982-1997, 28 pages.
www.mmsonline.com/columns/micro-keying-keeps-a-better-grip.aspx, Seibert, Stan, Modern Machine Shop: "Micro-Keying Keeps A Better Grip," Aug. 1, 1992, 2 pages.
MKT Geotechnical Systems, Manual No. 01807: "Operating, Maintenance and Parts manual for MS350 and MS500 Single-Acting Pile Hammers," undated, 12 pages.
Report identifying systems for driving mandrels carrying wick drain material into the earth, Ref. Nos. APE0510-APE0536, undated, 27 pages.
Schematic drawings, Ref. Nos. APE01038, APE01039, APE0339, undated, 3 pages.
Shanghai Jintai SEMW, undated, 8 pages.
"The 1st Report on the Treatment of Soft Foundation in Juck Hyun Industrial Site", Ref. Nos. APE00854-APE00856, 1976, 3 pages.
International Searching Authority, "International Search Report", Jan. 28, 2011, 11 pages.

* cited by examiner

INTERNAL PIPE CLAMP

RELATED APPLICATIONS

This application Ser. No. 13/077,664 claims the benefit of priority of U.S. Provisional Application Ser. No. 61/320,452, filed Apr. 2, 2010.

The contents of all related application(s) set forth above are incorporated herein by reference.

TECHNICAL FIELD

The present invention relates to pile driving systems and, more particularly, to pile driving systems adapted to drive and/or extract hollow pile members such as pipes.

BACKGROUND

Construction projects often require the placement of rigid elongate members into the ground. The rigid elongate members can manufactured from various shapes, sizes, and materials depending upon the intended use. The present invention is of particular significance in the context of driving a hollow pipe, such as a pipe pile or caisson, into the ground. For the purposes of describing the construction and use of the present invention, the term "pile" will be used herein to refer to any pile or caisson at least a portion of which is hollow.

Piles can be placed at a desired location in the ground using any one of a number of different methods. A hole can be excavated at the desired location, the pile inserted, and then backfill material can be arranged within the hole around the pile to secure the pile in place. More commonly, however, piles are driven into the ground using a pile driving system. A pile driving system typically applies a driving force on an upper end of the pile that drives or crowds the pile into the earth without excavation.

In some situations, the pile driving system combines a static driving force with vibratory forces to facilitate the driving and/or extracting of the pile. The static driving force is typically formed by the weight of the pile and the pile driving system and is directed along a drive axis that is substantially defined by a longitudinal axis of the pile. Typically, a support structure such as a crane is used to suspend the pile driving system and pile during operation of the pile driving system to insert and/or extract the pile.

The vibratory forces of a pile driving system that uses such forces are typically formed by a vibratory system that creates movement in both directions along the drive axis. A pile driving system that employs vibratory forces also typically employs a clamp system 20 to secure the vibratory system to the pile to ensure that the vibratory forces are effectively transmitted to the pile. In addition, a pile driving system employing vibratory forces further typically employs a suppressor for inhibiting the transmission of vibratory forces to the support structure.

The present invention relates to improved clamp system 20s and methods for vibratory pile driving systems for driving and/or extracting hollow piles such as pipe piles and caissons.

SUMMARY

The present invention may be embodied as a clamp system for connecting a vibratory system defining a drive axis to a pile defining a pile inner surface. The clamp system comprises a frame, a plurality of clamp members, an actuator collar, and an actuator system. The frame comprising an attachment member adapted to be operatively connected to the vibratory system and a stop ring defining a stop cam surface. The plurality of clamp members defines first and second cam surfaces. The actuator collar defines an actuator cam surface. The actuator system displaces the actuator collar. The frame supports the actuator collar and the plurality of clamp members such that the first cam surfaces engage the actuator cam surface and the second cam surfaces engage the stop cam surface. Operation of the actuator system displaces the actuator collar towards the stop ring. As the actuator collar moves towards the stop ring, the actuator cam surface acts on the first cam surfaces and the stop cam surface acts on the second cam surfaces such that the clamp members are displaced away from the drive axis to place the clamp system in an engaged configuration. The clamp members are adapted frictionally to engage the pile inner surface when the clamp system is in the engaged configuration.

The present invention may also be embodied as a method of connecting a vibratory system defining a drive axis to a pile defining a pile inner surface, the method comprising the following steps. A frame comprising an attachment member adapted to be operatively connected to the vibratory system and a stop ring defining a stop cam surface is provided. A plurality of clamp members each defining first and second cam surfaces is provided. An actuator collar defining an actuator cam surface is arranged such that the actuator cam surface engages the first cam surfaces defined by the plurality of clamp members. The plurality of clamp members are arranged relative to the frame such that the stop cam surface defined by the stop ring engages the second cam surfaces. An actuator system for displacing the actuator collar is provided. The actuator system is operated to displace the actuator collar towards the stop ring such that the actuator cam surface acts on the first cam surfaces and the stop cam surface acts on the second cam surfaces to displace the clamp members away from the drive axis to place the clamp system in an engaged configuration in which the clamp members are adapted frictionally to engage the pile inner surface.

The present invention may also be configured as a clamp system for connecting a vibratory system defining a drive axis to a pile defining a pile inner surface, the clamp system comprising a frame, a plurality of clamp members, an actuator collar, and an actuator system. The frame comprises an attachment member adapted to be operatively connected to the vibratory system, a stop ring defining a stop cam surface, and a center member for fixing a distance between the attachment member and the stop ring. The plurality of clamp members is secured to the center member for limited motion along the drive axis and radially from the drive axis. Each clamp member defines first and second cam surfaces. The actuator collar defines an actuator cam surface. The actuator system displaces the actuator collar. The frame supports the actuator system and the actuator collar such that the first cam surfaces engage the actuator cam surface and the second cam surfaces engage the stop cam surface. Operation of the actuator system displaces the actuator collar towards the stop ring. As the actuator collar moves towards the stop ring, the actuator cam surface acts on the first cam surfaces and the stop cam surface acts on the second cam surfaces such that the clamp members are displaced away from the drive axis to place the clamp system in an engaged configuration. The clamp members are adapted frictionally to engage the pile inner surface when the clamp system is in the engaged configuration.

DETAILED DESCRIPTION

Figure 1:
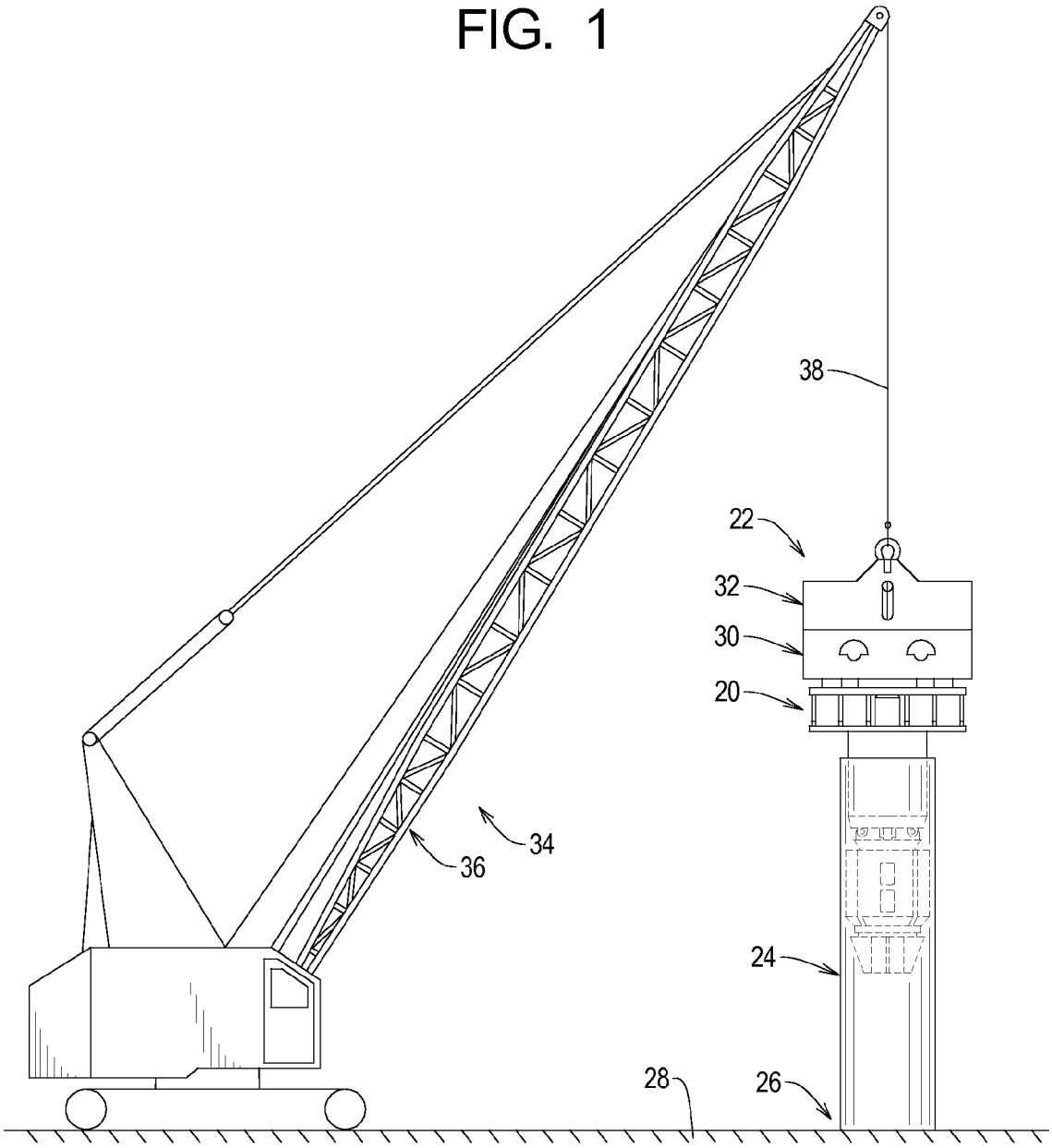
FIG. 1 is a side elevation view of an example pile driving system incorporating an example of an internal pipe claim system of the present invention.

FIG. 1 depicts a clamp system 20 forming part of a pile driving system 22 for driving a pile 24 into a desired location 26 in the earth 28. The example pile 24 is hollow and, more particularly, takes the form of a pipe or pipe pile.

In FIG. 1, the example pile driving system 22 comprises, in addition to the clamp system 20, a vibratory system 30 and a suppressor system 32. The pile driving system 22 and pile 24 are supported by a support structure 34 comprising a crane 36 and a crane line 38. The example crane line 38 is operatively connected to the suppressor 32, and the example suppressor 32 is rigidly connected to the vibratory system 30. The example vibratory system 30 is in turn rigidly connected to the clamp system 20. The example clamp system 20 substantially rigidly connects vibratory system 30 to the pile 24.

In general, the clamp system 20 is connected to the vibratory system 30 such that the vibratory forces are substantially rigidly transmitted or transferred from the vibratory system 30 to the clamp system 20. The clamp system 20 in turn engages the pile 24 such that the vibratory forces are substantially rigidly transmitted or transferred from the clamp system 20 to the pile 24 as will be described in further detail below.

Figure 2:
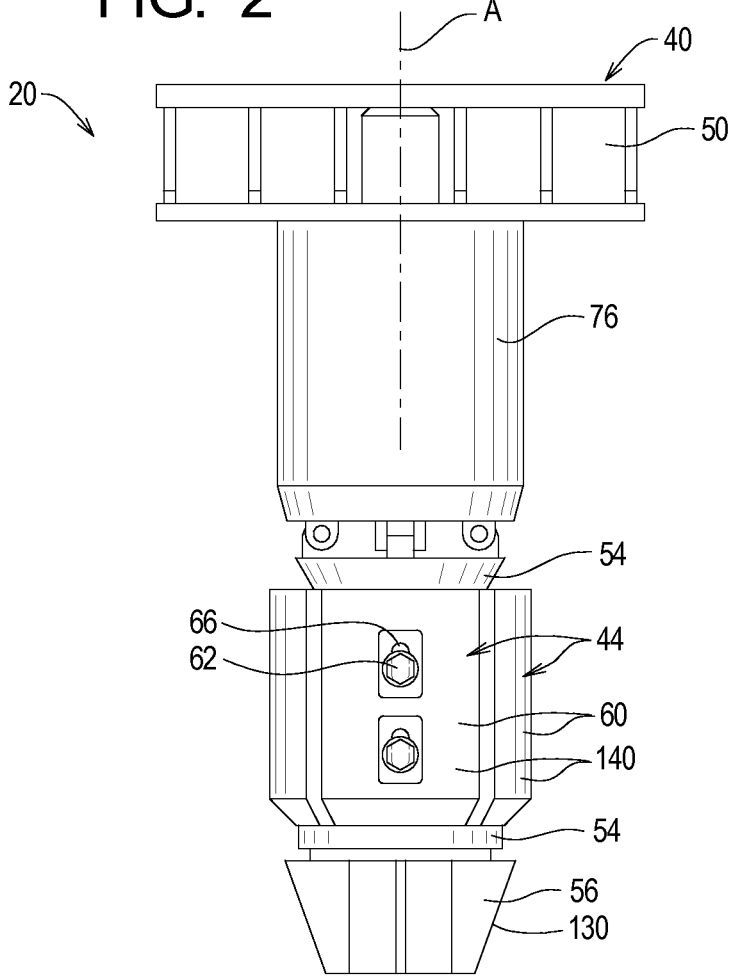
FIG. 2 is a side elevation view of the example of the internal pipe clamp system 20 depicted in FIG. 1.
Figure 3:
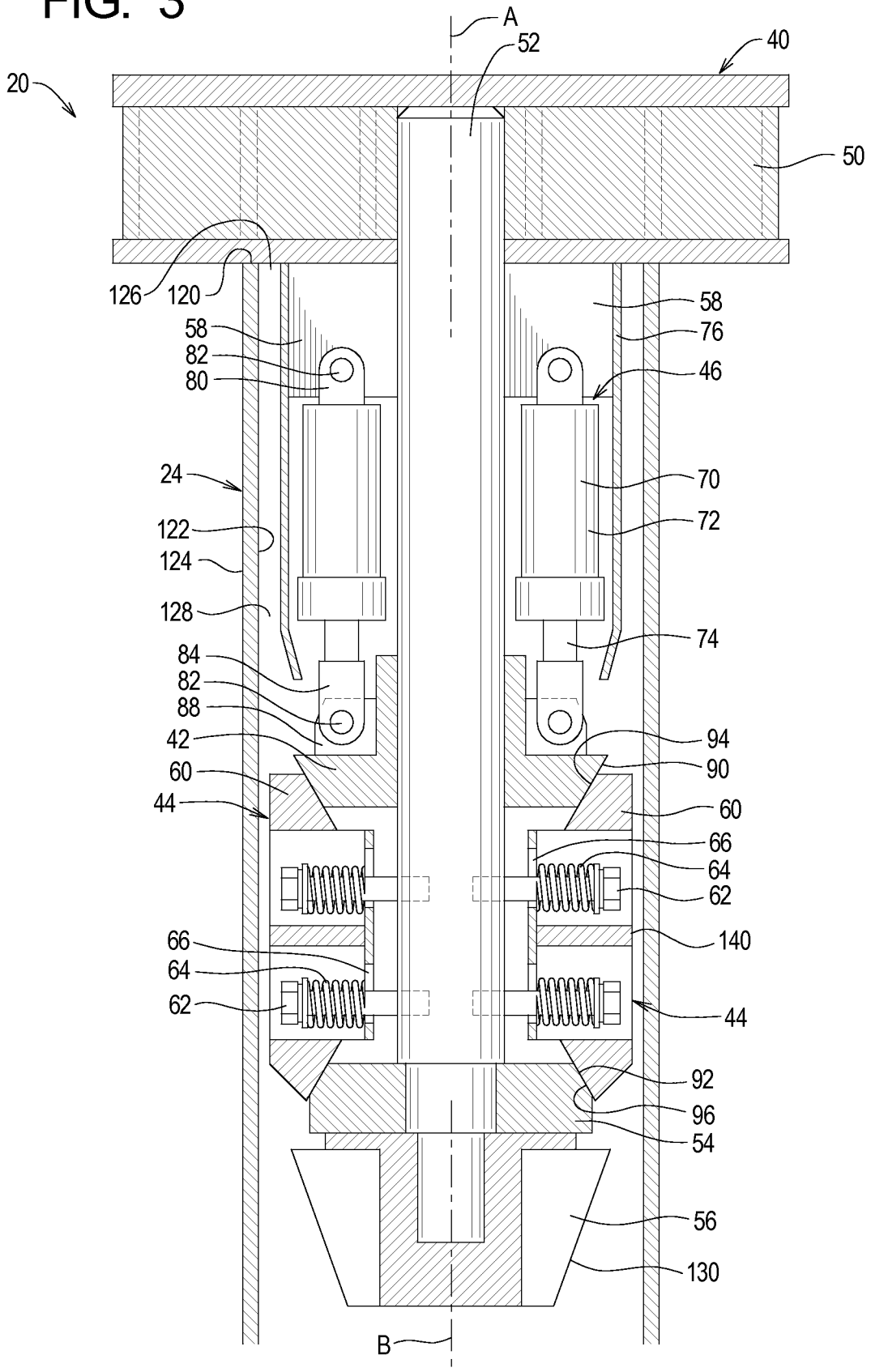
FIG. 3 is a side section view of the example internal pipe clamp system 20 of FIG. 1 in a disengaged configuration.
Figure 4:
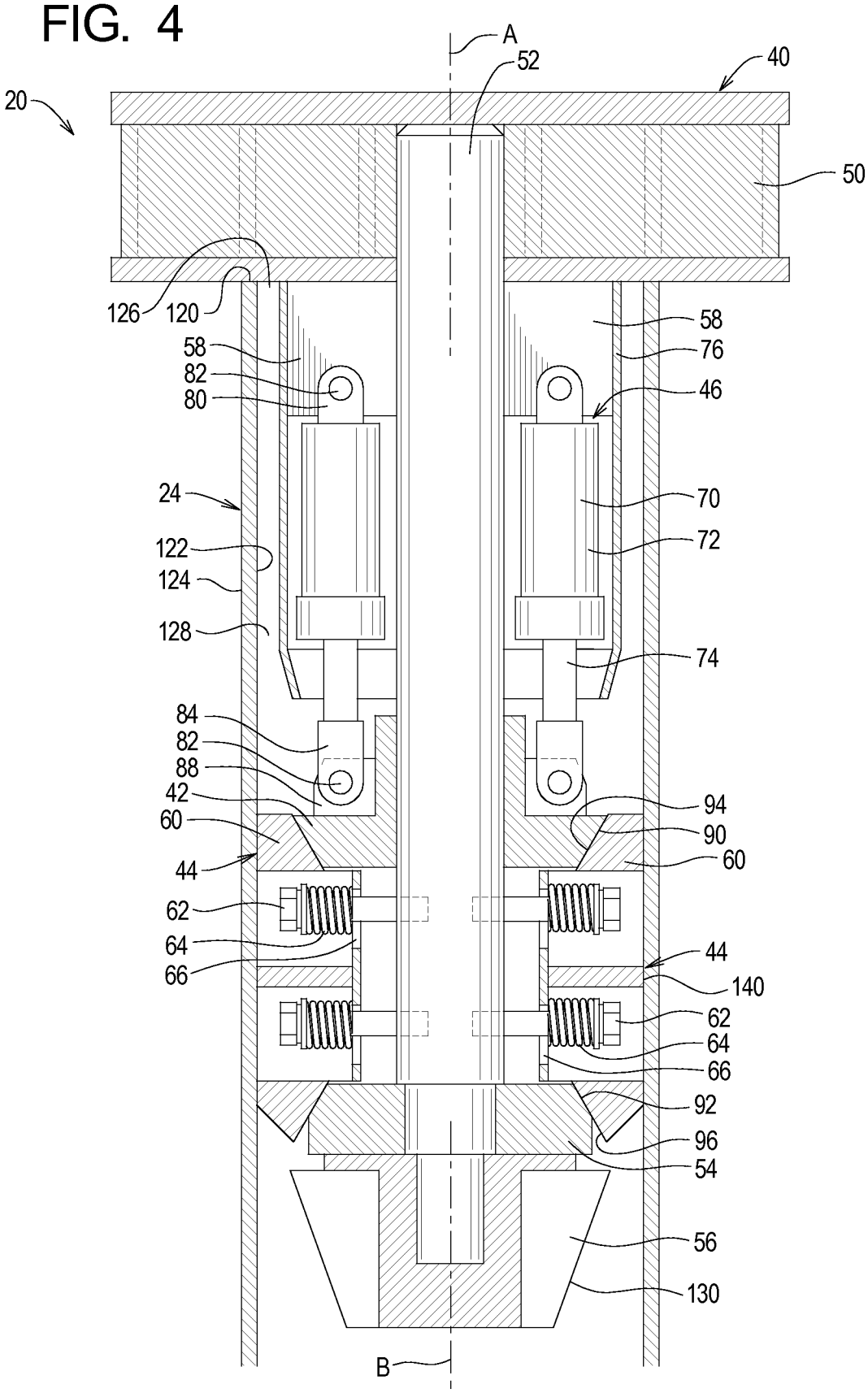
FIG. 4 is a side section view of the example internal pipe clamp system 20 of FIG. 1 in an engaged configuration.

FIG. 2 illustrates that the example clamp system 20 comprises a frame 40, an actuator collar 42, a plurality (two or more) clamp assemblies 44, and an actuator system 46. FIGS. 3 and 4 illustrate that the example frame 40 comprises an attachment member 50, a center member 52, a stop ring 54, a guide member 56, and a plurality (two or more) of cylinder flanges 58.

The example attachment member 50 takes the form of a beam that is adapted to be rigidly connected to the vibratory system 30 such that the attachment member 50 is substantially symmetrically arranged about a drive axis A defined by the vibratory system 30. The attachment member 50 is rigidly connected to a base location of the center member 52 such that the center member 52 substantially symmetrically extends along the drive axis A.

The example stop ring 54 is rigidly connected to the center member 52 at an intermediate location along the length of the center member 52. The guide member 56 is rigidly connected at an end location of the center member 52 distal from the attachment member 50. The intermediate location is spaced between the end location and the base location.

The example cylinder flanges 58 are rigidly connected to the attachment member 50 and/or the center portion 52 such that the cylinder to flanges 58 extend along the drive axis A and radially extend from the drive axis A.

The example clamp assemblies 44 each comprise a clamp member 60 operatively connected by at least one retaining bolt 62 such that the clamp members 60 may move between a disengaged position (FIG. 3) and an engaged position (FIG. 4) relative to the center member 52. Return springs 64 are configured to bias the clamp members 60 into the disengaged position. The example clamp members 60 are arranged in groups of two opposing clamp members. The example clamp system 20 comprises four of the example clamp assemblies 44, so the example clamp members 60 are arranged in two groups of two, with each clamp member 60 arranged on an opposite side of the drive axis A from the other clamp member 60 in its group. In addition, in the example clamp system 20, each clamp member 60 is provided with two of the retaining bolts 62 and two of the return springs 64.

When moving between the disengaged and engaged positions, the example clamp members 60 move both along the drive axis A and radially with respect to the drive axis A. In particular, at least one slot 66 is formed in each of the clamp members 60 to allow movement of the clamp members 60 within a limited range of movement along the drive axis A. In this context, the retaining bolts 62 and compression and expansion of the return springs 64 allow movement of the clamp members 60 within a limited range radially with respect to the drive axis A. In the example clamp system 20, one of the slots 66 is provided for each of the retaining bolts 62, so two slots 66 are formed in the example clamp members 60.

The example actuator system 46 comprises at least one actuator 70 comprising a cylinder 72 and a shaft 74. As is conventional, energizing the actuator 70 in at least a first mode causes the shaft 74 to be extended from a retracted configuration (FIG. 3) towards an extended configuration (FIG. 4) relative to the cylinder 72. Optionally, the actuator 70 may be energized in a second mode in which the shaft is retracted from the extended configuration towards the retracted configuration with respect to the cylinder 72. The actuators 70 may be pneumatic, electrical, or hydraulic devices as necessary to exert sufficient clamping force as will be described in further detail below. The example actuators 70 are conventional hydraulic devices powered by pressurized hydraulic fluid. The example actuator system 46 of the example clamp system 20 comprises four actuators, one for each of the clamp assemblies 44. The example actuator system 46 further comprises an actuator housing 76 that extends from the attachment member 50 and protects the actuator system 46.

A cylinder coupler 80 is rigidly secured to the cylinder 70, and a cylinder pin 82 operatively connects the cylinder 72 for pivoting movement relative to the cylinder flange 58 of the frame 40. A shaft coupler 84 is rigidly secured to the shaft 74, and a shaft pin 82 operatively connects the shaft 74 for pivoting movement relative to a shaft flange 88 forming part of the actuator collar 42 of the example clamp system 20.

The actuator collar 42 defines an actuator cam surface 90, while the stop ring 54 defines a stop cam surface 92. Each of the clamp members 60 defines a first cam surface 94 and a second cam surface 96. The actuator cam surface 90 and the first cam surface 94 are configured to extend at a first angle with respect to the drive axis A, while the stop cam surface 92 and the second cam surface 96 are configured to extend at a second angle with respect to the drive axis A.

Accordingly, with the actuator collar 42 pivotably connected to the actuators 70 and the clamp members 60 movably secured relative to the center member 52 as depicted in FIGS. 3 and 4, the return springs 64 bias the clamp members 60 towards the drive axis A such that the first cam surfaces 94 engage the actuator cam surface 90. Similarly, with the stop ring 54 rigidly supported by the center member 52 and the clamp members 60 movably secured relative to the center member 52 as depicted in FIGS. 3 and 4, the return springs 64 bias the clamp members 60 towards the drive axis A such that the second cam surfaces 96 engage the stop cam surface 92.

With reference to FIGS. 3 and 4, the use of the example clamp assembly 20 will now be described in further detail. Initially, it should be noted that the pile 24 comprises a pile upper edge 120, a pile inner surface 122, and a pile outer surface 124. The pile upper edge 120 defines a pile opening 126, and the pile inner surface 122 defines a pile chamber 128. The pile 24 further defines a pile axis B.

To begin the process of engaging the clamp system 20 with the pile 24, the actuators 70 are first arranged in the retracted configuration such that the clamp members 60 are in the disengaged configuration. The pile driving system 22 is then displaced such that the clamp system 20 is inserted at least partly through the pile opening 126 and substantially arranged within the pile chamber 128. The guide member 56 defines slanted guide surfaces 130 that engage the pile upper edge 120 and guide the clamp system 20 through the pile opening 126 and into the pile chamber 128. The clamp system 20 may be arranged such that the pile upper edge 120 engages the attachment member 50, or the pile upper edge 120 may be spaced from the attachment member 50. FIGS. 3 and 4 illustrate the situation in which the pile upper edge 120 engages the attachment member 50. At this point, the drive axis A may not be aligned with the pile axis B.

The actuators 70 are next energized in the first mode to extend the shafts 74 relative to the cylinders 72. As the shafts 74 move towards the extended configuration, the actuator collar 42 is displaced along the drive axis A away from the attachment member 50 and towards the stop ring 54. As the actuator collar 42 moves towards the stop ring 54, the actuator cam surface 90 engages the first cam surfaces 94 and the stop cam surface 92 engages the second cam surfaces 94. To accommodate this displacement of the movable actuator collar 42 relative to the fixed stop ring 54, the respective cam surfaces 90 and 92 engage the associated cam surfaces 94 and 96, respectively, to cause the clamp members 60 to move away from the drive axis A. The return springs 64 compress to allow the movement of the clamp members 60 away from the drive axis A.

Eventually, the distance between outer surfaces 140 of the clamp members 60 equals the distance between opposite portions of the pile inner surface 122 and the clamp members 60 engage the pile 24. The clamp members 60 frictionally engage the pile 24 at this point. Additionally, the clamp system 20 will selfcenter such that the drive axis A is substantially aligned with the pile axis B.

It should be noted that the actuator system 46 and clamp assemblies 44 should be configured such that the distance between opposing outer surfaces 140 of the clamp members 60 may be greater than the inner diameter of the pile 24 when the actuators 70 are in the fully extended configurations. The actuators 70 may thus be configured to apply sufficient clamping pressure to the clamp members 60 such that the clamp members frictionally engage the pile inner surface 122 to inhibit movement of the clamp members 60 relative to the pile during normal operation of the pile driving system 22. The pile driving system 22 is then operated to drive the pile 24 to a desired depth at the desired location 26.

To disengage the clamp system 20 from the pile 24, the actuators 70 may be placed in a de-energized configuration to allow the return springs to force the clamp members 60 towards the drive axis A and thus the actuator collar 42 towards the attachment member 50, thereby forcing the shafts 74 towards the retracted configuration with respect to the cylinders 72. Optionally, the actuators 70 may be energized in the second mode to force the shafts into the retracted configuration. At some point between the engaged configuration and the disengaged configuration, the clamp members 60 disengage from the pile inner surfaces 122, allowing the clamp system 20 to be removed from the pile chamber 128.

A clamp system such as the example clamp system 20 described above allows the pile 24 to be driven without engaging the pile external surface.

What is claimed is:

1. A clamp system for connecting a vibratory system defining a drive axis to a pile defining a pile inner surface, the clamp system comprising:
- a frame comprising
  - an attachment member adapted to be operatively connected to the vibratory system, and
  - a stop ring defining a stop cam surface;
- a plurality of clamp members defining first and second cam surfaces;
- an actuator collar defining an actuator cam surface;
- an actuator system for displacing the actuator collar; whereby
- the frame supports the actuator collar and the plurality of clamp members such that the first cam surfaces engage the actuator cam surface and the second cam surfaces engage the stop cam surface;
- operation of the actuator system displaces the actuator collar towards the stop ring;
- as the actuator collar moves towards the stop ring, the actuator cam surface acts on the first cam surfaces and the stop cam surface acts on the second cam surfaces such that the clamp members are displaced away from the drive axis to place the clamp system in an engaged configuration; and
- the clamp members are adapted frictionally to engage the pile inner surface when the clamp system is in the engaged configuration.

2. A clamp system as recited in claim 1, further comprising at least one return spring, where the at least one return spring is arranged to bias one of the clamp members towards the drive axis.

3. A clamp system as recited in claim 1, further comprising at least one retaining bolt, where the at least one retaining bolt is arranged to secure one of the clamp members relative to the frame.

4. A clamp system as recited in claim 3, further comprising at least one slot formed in each clamp member, where the at least one retaining bolt extends through the at least one slot to allow movement of the clamp member along the drive axis.

5. A clamp system as recited in claim 1, further comprising:
- first and second retaining bolts, where the first and second retaining bolts are arranged to secure each of the clamp members relative to the frame; and
- first and second slots formed in each clamp member, where the first and second retaining bolts extend through the first and second slots, respectively, to allow movement of the clamp members along the drive axis.

6. A clamp system as recited in claim 1, in which the actuator system comprises a plurality of actuators.

7. A clamp system as recited in claim 1, in which:
- the actuator system comprises at least one actuator member comprising a cylinder and a shaft;
- the cylinder is rotatably secured to a portion of the frame;
- the shaft is rotatably secured to a portion of the actuator collar; and
- energizing the actuator members in a first mode extends the shaft from the cylinder to displace the actuator collar towards the stop ring.

8. A clamp system as recited in claim 1, in which the frame comprises a center member for fixing a distance between the stop ring and the attachment member.

9. A clamp system as recited in claim 1, in which the frame further comprises a guide member defining slanted guide surfaces.

10. A clamp system as recited in claim 1, in which:

the actuator system comprises actuator member for each clamp member, where each actuator member comprises a cylinder and a shaft;

the cylinders are rotatably secured to a portion of the frame;

the shafts are rotatably secured to a portion of the actuator collar; and energizing the actuator members in a first mode extends the shaft from the cylinder to displace the actuator collar towards the stop ring.

11. A method of connecting a vibratory system defining a drive axis to a pile defining a pile inner surface, the method comprising the steps of:

providing a frame comprising an attachment member adapted to be operatively connected to the vibratory system, and a stop ring defining a stop cam surface;

providing a plurality of clamp members each defining first and second cam surfaces;

arranging an actuator collar defining an actuator cam surface such that the actuator cam surface engages the first cam surfaces defined by the plurality of clamp members;

arranging the plurality of clamp members relative to the frame such that the stop cam surface defined by the stop ring engages the second cam surfaces;

providing an actuator system for displacing the actuator collar; and operating the actuator system to displace the actuator collar towards the stop ring such that the actuator cam surface acts on the first cam surfaces and the stop cam surface acts on the second cam surfaces to displace the clamp members away from the drive axis to place the clamp system in an engaged configuration in which the clamp members are adapted frictionally to engage the pile inner surface.

12. A method as recited in claim 11, further comprising the step of arranging at least one return spring to bias one of the clamp members towards the drive axis.

13. A method as recited in claim 11, further comprising the step of arranging at least one retaining bolt to secure one of the clamp members relative to the frame.

14. A method as recited in claim 13, further comprising the steps of:

forming at least one slot formed in each clamp member; and extending the at least one retaining bolt through the at least one slot to allow movement of the clamp member along the drive axis.

15. A method as recited in claim 11, further comprising the steps of:

forming first and second slots in each clamp member; and arranging first and second retaining bolts so that the first and second retaining bolts extend through the first and second slots, respectively, to limit movement of the clamp members along the drive axis relative to the frame.

16. A method as recited in claim 11, in which:

the actuator system comprises at least one actuator member comprising a cylinder and a shaft;

the cylinder is rotatably secured to a portion of the frame;

the shaft is rotatably secured to a portion of the actuator collar; and energizing the actuator members in a first mode extends the shaft from the cylinder to displace the actuator collar towards the stop ring.

17. A clamp system for connecting a vibratory system defining a drive axis to a pile defining a pile inner surface, the clamp system comprising:

a frame comprising an attachment member adapted to be operatively connected to the vibratory system, a stop ring defining a stop cam surface, and a center member for fixing a distance between the attachment member and the stop ring;

a plurality of clamp members secured to the center member for limited motion along the drive axis and radially from the drive axis, where each clamp member defines first and second cam surfaces;

an actuator collar defining an actuator cam surface;

an actuator system for displacing the actuator collar; whereby the frame supports the actuator system and the actuator collar such that the first cam surfaces engage the actuator cam surface and the second cam surfaces engage the stop cam surface;

operation of the actuator system displaces the actuator collar towards the stop ring;

as the actuator collar moves towards the stop ring, the actuator cam surface acts on the first cam surfaces and the stop cam surface acts on the second cam surfaces such that the clamp members are displaced away from the drive axis to place the clamp system in an engaged configuration; and the clamp members are adapted frictionally to engage the pile inner surface when the clamp system is in the engaged configuration.

18. A clamp system as recited in claim 17, further comprising at least one return spring for each clamp member, where the return springs are arranged to bias the clamp members towards the drive axis.

19. A clamp system as recited in claim 18, further comprising at least one retaining bolt for each clamp member, where the retaining bolts are arranged to limit movement of the clamp members relative to the frame.

20. A clamp system as recited in claim 19, further comprising at least one slot formed in each clamp member, where the retaining bolts extend through the slots to allow movement of the clamp member along the drive axis.

* * * * *